United States Patent [19]

Katsuji

[11] 4,221,247

[45] Sep. 9, 1980

[54] VENEER LATHE

[75] Inventor: Hasegawa Katsuji, Ohbu, Japan

[73] Assignee: Meinan Machinery Works, Inc., Ohbu, Japan

[21] Appl. No.: 861,278

[22] Filed: Dec. 16, 1977

[30] Foreign Application Priority Data

Jan. 21, 1977 [JP] Japan ..... 52-6288

[51] Int. Cl.[2] ..... B27L 5/02

[52] U.S. Cl. ..... 144/211; 144/213

[58] Field of Search ..... 144/209 R, 211, 212, 144/213, 214, 215, 323

[56] References Cited

U.S. PATENT DOCUMENTS

| | | | |
|---|---|---|---|
| 153,365 | 7/1874 | Munn | 144/212 |
| 435,480 | 9/1890 | Chapman | 144/211 |
| 463,888 | 11/1891 | Chapman | 144/211 |
| 525,613 | 9/1894 | Nier | 144/211 |
| 633,548 | 9/1899 | Fenlason | 144/215 |
| 1,641,452 | 9/1927 | Osgood | 144/213 |
| 3,480,053 | 11/1969 | Whipple | 144/213 |
| 4,061,169 | 12/1977 | Hasegawa | 144/213 |

*Primary Examiner*—W. Donald Bray

*Attorney, Agent, or Firm*—Jacobi, Lilling, Siegel & Presta

[57] ABSTRACT

An improved veneer lathe which cuts off a sheet of veneer from a log supported rotatably by applying a torque directly to the outer periphery of the log. An external force for cutting the log is fed from the vicinity of a knife included in the lathe. The log core is not subjected to a load attributable to a cutting resistance so that even logs of a poor quality are usable for turning veneer sheets therefrom, enhancing the yield of plywood production.

21 Claims, 16 Drawing Figures

VENEER LATHE

BACKGROUND OF THE INVENTION

The present invention relates to a veneer lathe and, more particularly, to an improved veneer lathe which cuts off acceptable sheets of veneer even from logs of a relatively poor quality.

A conventional veneer lathe includes a cutting section made up of a knife and a stationary bar which may be replaced partly by a roller bar. A cutting power is transmitted to the cutting section through a chuck adapted to retain a log. One of veneer lathes employing such known technique is disclosed in U.S. Pat. No. 1,641,452. Known veneer lathes of the type described involve drawbacks in various respects as discussed hereinbelow.

First, hard logs, logs having soft cores and logs with splits are not suitable for use and, if used, might cause a chuck to race with the consequent interruption of the power supply and/or result in the breakage of the logs disabling the cutting operation. This is because the supply of the power occurs against a large cutting resistance through the log from centre to cutting surface.

Second, slivers and chips resulting from the cutting of a log are more liable to become wedged in a space adjacent to the cutting edge of the knife if the power is supplied from the core portion. This and other similar troubles occur frequently when logs to be cut have splits and/or rotten spots. The drawbacks described above are detrimental to the rate of operation of a veneer lathe and to the yield as well.

In view of an unavoidable influence of the above problems on the product, logs have hitherto been supplied in two different classes, i.e. logs applicable and unapplicable to the production of plywood. However, the short supply of logs is now so serious that logs of a poor quality must be used. Meanwhile, cutting devices including veneer lathes and slicers constitute an important field in the process of plywood production in which logs are turned into sheets of veneer. The construction of a veneer lathe or any other cutting device dictates the yield since the flow in steps succeeding the cutting step and the quality of the product depend primarily on the grading of logs into applicable and unapplicable classes. A veneer lathe disclosed in U.S. Pat. No. 1,641,452 has a roller bar operatively connected with a drive source through an overrunning clutch as its characteristic feature, but it is not of a design which, as in the present invention described hereinafter, applies a driving force to the outer periphery of a log and, hence, the problems of the prior art still remain unsolved.

SUMMARY OF THE INVENTION

It is therefore an object of the present invention to provide a veneer lathe which accommodates the use of hard logs and logs having soft cores which are hard to cut with a prior art veneer lathe and a presumable future use of miscellaneous trees.

To achieve this objective, a veneer lathe according to the present invention comprises means for supporting a logs rotatably about its axis, a knife oriented in tangential relation to the log with its cutting edge substantially near the point of tangency, a drive roller located in a position slightly ahead of the cutting edge of the knife with its outer periphery opposed to the outer periphery of the log, a plurality of edge members carried on the outer periphery of the drive roller at predetermined circumferential spacings in such a manner as to cut into the log slightly ahead of the edge of the knife and means for moving or feeding the knife and drive roller toward the log in faithful relation with the rotation of the log.

BRIEF DESCRIPTION OF THE DRAWINGS

The invention will be further described hereinafter in connection with the accompanying drawings, in which.

DESCRIPTION OF THE PREFERRED EMBODIMENTS

Figure 1:
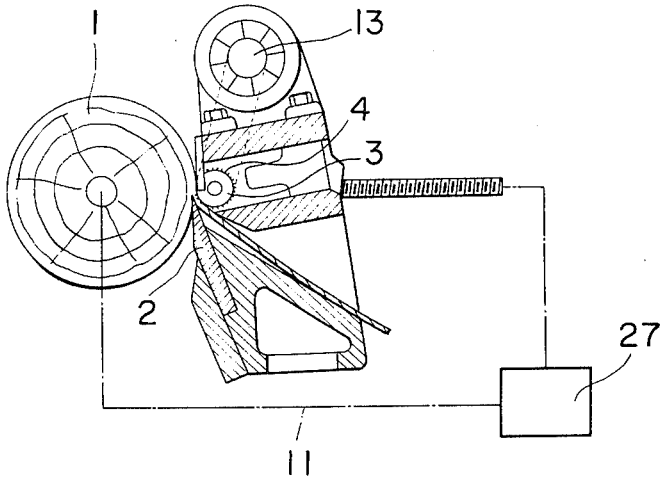
FIG. 1 is a schematic diagram showing an essential construction of a veneer lathe according to the present invention.
Figure 2A:
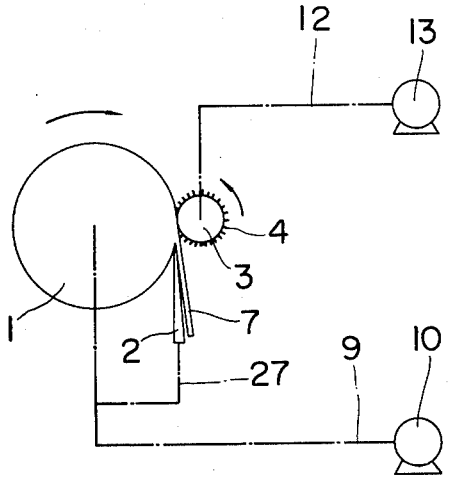
FIGS. 2-*a* to 2-*d* diagrammatically illustrate various examples of a drive system forming embodiments of the present invention.
Figure 2B:
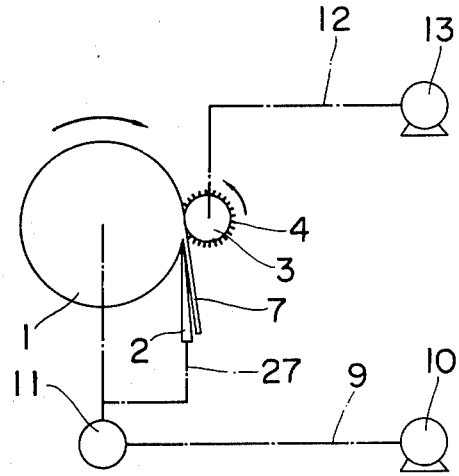
Figure 2C:
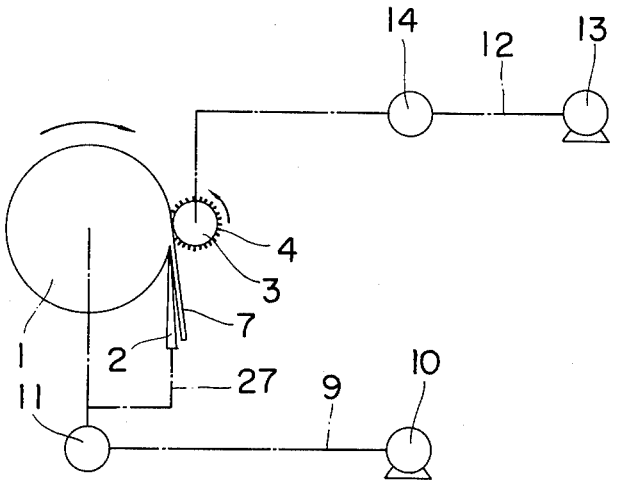
Figure 2D:
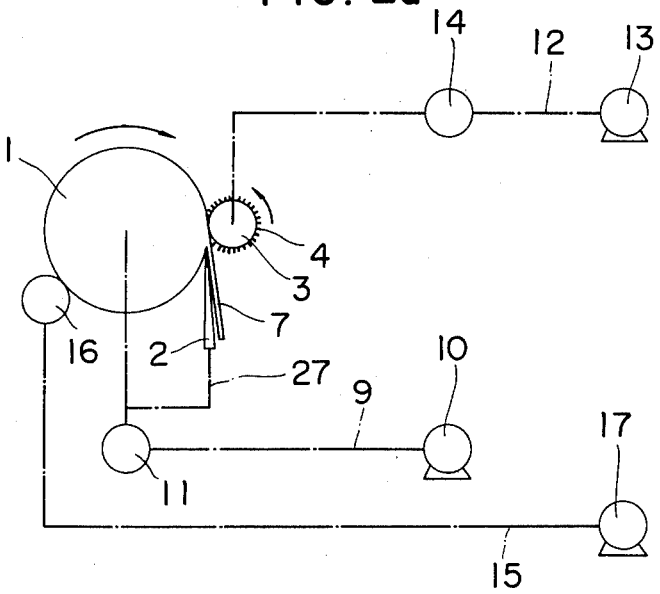

Referring to FIG. 1, reference numeral 1 designates a log supported rotatably about its axis and from which a sheet of veneer is to be cut off. A knife 2 is located in tangential relation to the log 1 with its cutting edge positioned substantially at the point of tangency. A drive roller 3 is provided in a position slightly ahead of the edge of the knife 2 in such a manner that its outer periphery opposes to that of the log. A plurality of edge members 4 are carried on the outer periphery of the drive roller 3 at predetermined circumferential spacings and are engageable with or cut into part of the outer periphery of the log which is about to be cut by said knife. Denoted 27 is a feed mechanism adapted to move the knife 2 and drive roller 3 in faithful relation with the rotation of the log.

A first example of a drive system for the above arrangement is illustrated in FIG. 2-*a*. As shown, the drive roller 3 is driven by a drive mechanism 12 and an electric motor 13 so as to apply a force to the log slightly ahead of the edge of the knife 2. The log, on the other hand, is driven for rotation by a drive mechanism 9 and an electric motor 10. The knife 2 and drive roller 3 can therefore be moved toward the log 1 while the latter is rotating at the start of cutting operation and, hence, the drive roller is allowed to drive the log smoothly. The torque of the drive mechanism 9 rotating the log is preselected to be smaller than the one which is necessary for cutting the log, so that the log thus driven by the drive roller is cut into a sheet of veneer 7 at the peripheral speed of the roller. In other words, the torque or power capacity derived from the motor 10 and transmitted through a chuck to the log is smaller than that fed from the motor 13 thereby avoiding breakage of the log. The power supplied from the drive mechanism 9 is available for cutting purposes when the supply of the power is continued even after the log drive by the drive roller 3 is started. Since the diameter of the log varies as the cutting operation proceeds, the feed mechanism 27 operable in relation with the rotation of the log is so constructed as to feed the knife and drive roller in synchronism with the revolution of the motor 10.

Figure 4:
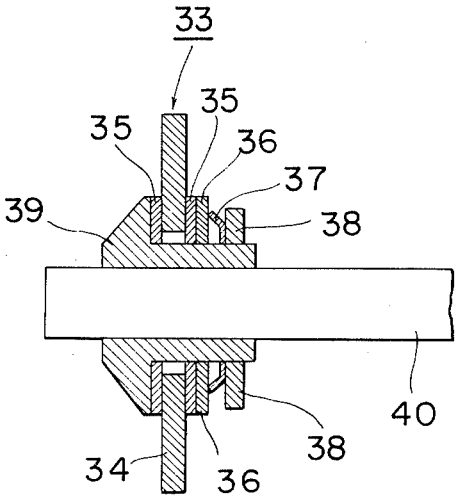
FIG. 4 is a section of a friction clutch applicable to log driving means included in the examples of FIGS. 2-*b* to 2-*d;*

A second example of the drive system shown in FIG. 2-*b* is similar to the example of FIG. 2-*a* except that the motor 10 does not regulate the power and that an idle mechanism 11 is included. More specifically, a friction clutch 33 illustrated in FIG. 4 is provided to a portion which rotatably supports the log 1 to thereby regulate the transmission torque or power capacity of the motor 10 and, therefore, to prevent the log 1 from being damaged. Turning now to FIG. 4, the friction clutch 33 comprises a sprocket 34 connected with the motor 10 by a chain, a pair of friction plates 35 bearing against axially opposite ends of the sprocket 34 and having a specific coefficient of friction, a presser plate 36 for pressing the adjacent friction plate 35 axially into engagement with the sprocket 34, an initially coned disc spring 37 held in resilient engagement with the presser plate 36 and an adjusting nut 38 bearing against the spring 37. Also included in the friction clutch is a rotary member 39 rigidly mounted on a rotatable shaft 40. The adjusting nut 38 is screwed over the rotary member 39. With this clutch arrangement, a power from motor 10 is transmitted to the shaft 40 with the aid of a frictional force which is determined by the coefficient of the friction plates 35 and the resilient force of the spring 37, whereby the chuck located on the extension of the shaft 40 is caused to drive the log 1 for rotation. However, when the force transferred to the sprocket 34 increases beyond the frictional force defined above, the friction plates 35 are allowed to slip on the sprocket thereby interrupting the transmission path of the power from the motor 10 to the log 1. It will thus be seen that the adjustment of the nut 38 regulates the transmission torque to a desired value.

Figure 5:
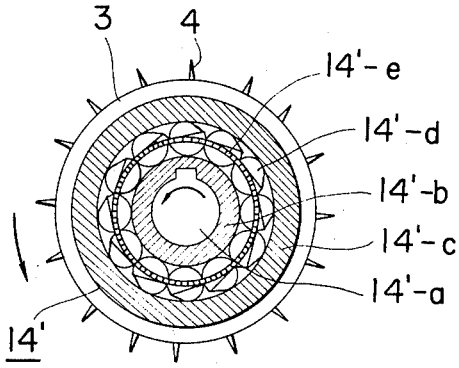
FIG. 5 is a section of an overrunning cluth installed in a drive roller included in the arrangments of FIGS. 2-*c* and 2-*d;*

A third example of the drive system is shown in FIG. 2-*c* which includes an overrunning mechanism 14 in addition to the mechanisms of FIG. 2-*b*. As depicted in FIG. 5, the overrunning mechanism 14 comprises an overrunning clutch 14' disposed inside the drive roller 3 in driven connection with a power source afforded by motor 13. The clutch assembly 14' is made up of an inner cylindrical member 14'-*b* rigidly and integrally mounted on a shaft portion 14'-*a* connected with the motor 13, an outer cylindrical member 14'-*c* integrally mounted to the inner peripheral wall of the drive roller 3 and a plurality of cams 14'-*d* interposed between the inner and outer rings 14'-*b* and 14'-*c* in the illustrated manner. The function of the overrunning mechanism is to cope with an occurrence wherein the peripheral speed of the log driven by the motor 10 under non-cutting conditions grows higher than that of the drive roller under loaded cutting conditions. When the peripheral speed of the log 1 becomes higher than that of the drive roller 3, the edge members 4 cutting into the log 1 cause the drive roller 3 and the outer ring 14'-*c* mounted thereto rotate faster than the shaft portion 14'-*a* and inner ring 14'-*b* in a direction indicated by an arrow in the drawing. The cams 14'-*d* then move from their first position to a second position in which the operative connection between the inner and outer rings of the clutch is interrupted, so that the drive roller 3 only idles irrespective of the power fed from the motor 10. As the peripheral speed of the rotating log is decreased progressively by the idle mechanism 11, e.g. friction clutch 33, until below the peripheral speed of the drive roller 3, the cams 14'-*d* are brought back to their first position to transmit power from the motor 13 to the drive roller 3. The above-described overrunning mechanism is provided because it is difficult to establish peripheral speeds of the log and drive roller 3 accurately equal to each other at the start of a cutting operation and because the friction clutch or any other idle mechanism tends to fail to kill the inertia energy of the log 1 and the like altogether, after the interruption of the torque transmission. The provision of the overrunning clutch 14' inside the drive roller 3 is advantageous in that the drive roller 3 accelerates the log smoothly to avoid a friction which would otherwise result from a difference between the peripheral speed of the log and that of the drive roller 3 at the start of a cutting operation. The overrunning mechanism 14 associated with the mechanism 12 for driving the drive roller 3 offers an advantage in that, since cutting of the log can be started at a peripheral speed which can be far higher than that of the drive roller 3, the high kinetic energy of the log will compensate for an insufficiency, if any, in the power supplied from the drive roller 3 at the start of a cutting operation and will thus promote smooth cutting. The supply of a power utilizing inertia as above involves little fear of the breakage of a log. It is preferable in this instance that, the overrunning clutch is mounted in a position as close to the edge members 4 as possible as shown in the drawing to minimize the inertia of the member preceding the overrunning assembly.

FIG. 2-*d* shows a fourth example of the drive system which further includes an auxiliary drive mechanism 15 as well as the mechanisms of the FIG. 2-*c* example. The mechanism 15 comprises an auxiliary drive roller 16 and an electric motor 17. The roller 16 is held in engagement with the outer periphery of a log 1 to provide an auxiliary driving force to the log. The illustration position of the auxiliary drive roller 16 which is substantially opposite to the drive roller 3 with respect to the log backs the log up against the pressure force of the drive roller 3 that would warp the log upon decrease in the diameter of the latter. However, the position of the roller may be suitably selected in consideration of its positional relationship with other members. Though the log can idle at a peripheral speed higher than that provided by the drive roller and, accordingly, the log drive mechanism is capable of establishing a somewhat higher peripheral speed, the peripheral speed of the log during cutting operation conforms basically to the peripheral speed given by the drive roller 3. Consequently, almost all of the power supplied from the log drive mechanism can be utilized as an assistance to the cutting of the log and a feeding power. In case where the power supply from the log drive mechanism is designed to continue even after the drive roller starts to drive a log, the provision of the overrunning clutch 14' serves to maintain substantially the same external force applied from the log drive mechanism to the log even though the idling peripheral speed may be higher than the peripheral speed provided by the drive roller 3. Hence, the external force from the log drive mechanism helps the drive roller 3 rotate the log, and is advantageous over a construction wherein it only interferes with the drive of a log. A machine of this structure will prove more effective when incorporating a friction clutch in its log drive mechanism, and a friction clutch if incorporated in the auxiliary drive mechanism 15, which applies a power to the outer periphery of a log, will avoid the transfer of an excessive torque to the log. Moreover, the contact portion of the roller 16 is permitted to slip on the log.

Figure 3:
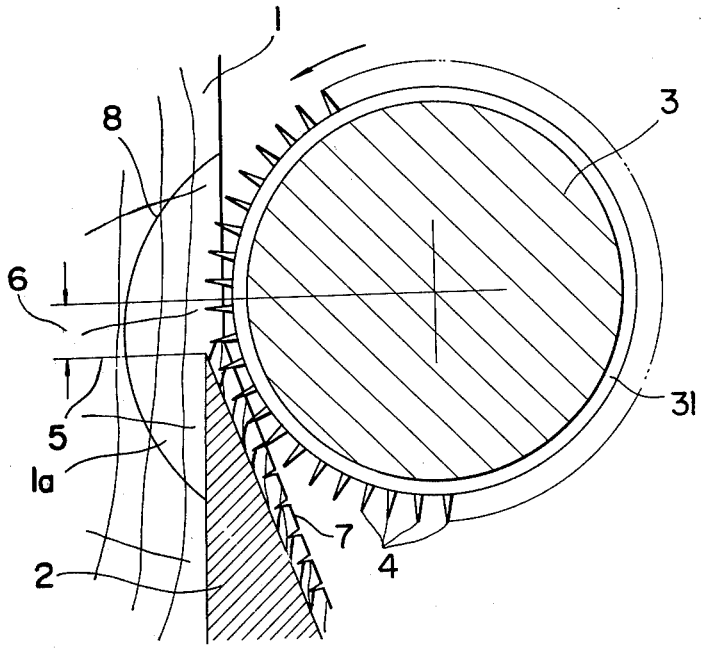
FIG. 3 shows in a side elevation essential part included in the arrangements of FIGS. 2-*a* to 2-*d;*

FIG. 3 is an enlarged fragmentary view of parts included commonly in the first to the fourth examples of a drive system described above. As shown, a drive roller 3 having a number of edge members 4 on its outer periphery is located in a position slightly ahead of the edge of a knife 2 and such that the axis of rotation of the drive roller is placed above the cutting edge by a distance 6 from a line 5 indicating the rotational axis of log 1 and the edge of the knife 2. A passage for a sheet of veneer 7 is defined between the knife 2 and the drive roller 3. Each of the edge members 4 extend radially outwardly from the outer periphery of the drive roller. Since the log 1 is rotatably supported, the force exterted directly to a defective portion 1*a* does not make it break away from a log inperfection 8, thus avoiding blockage of the veneer path between the drive roller 3 and the knife 2.

Figure 6:
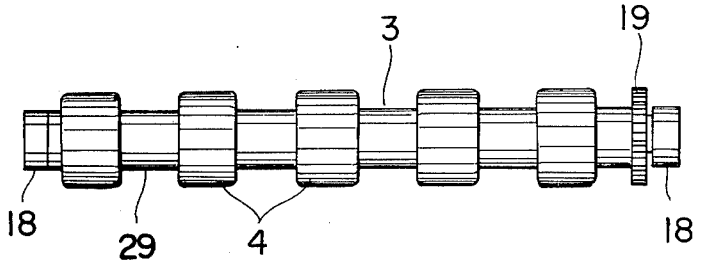
FIG. 6 is a front view of one example of a drive roller.

The edge members 4 of the drive roller 3 may comprise elongate members each extending axially from one end over to the other of the drive roller. Alternatively, as depicted in FIG. 6, a drive roller 3 may carry on its outer periphery a plurality of edge members 4 axially spaced from neighboring ones and each having edges circumferentially aligned with one another, thereby forming a plurality of disc-like portions on the drive roller and a plurality of annular recesses alternating with the disc-like portions. The edge members 4 shown in FIG. 6 are replacably mounted on a shaft 29 of the drive roller 3. Such a configuration will facilitate ready machining and assemblage of the drive roller 3 and edge members 4. A bearing and a sprocket are designated by reference numerals 18 and 19 in FIG. 6.

Figure 7:
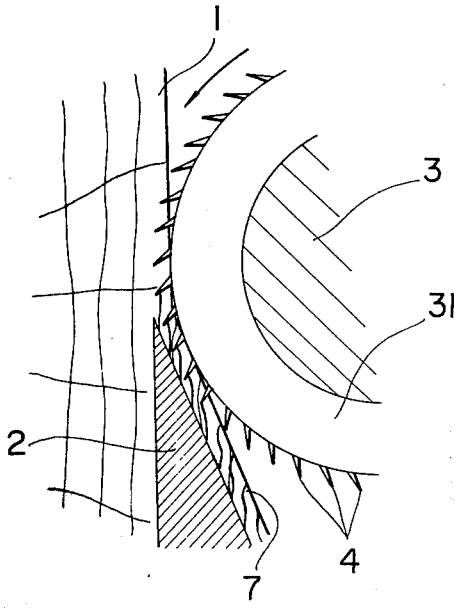
FIG. 7 shows another example of a drive roller in a side elevation.

Another alternative of the edge members is illustrated in FIG. 7. The edge members 4 are inclined forwardly at a predetermined angle with respect to the intended direction of rotation of the drive roller 3. This structure makes it possible to form deep cuts in the log. As a result, a veneer sheet is cut off in a more tenderized condition, thus improving its surface quality.

The drive motor in practical use is 140 mm in diameter and driven by a torque of 200 kg per meter for the rotation of 100 revolutions per minute. The edge members are circumferentially arranged with spacings of 10 mm on the roller periphery. Its adjacent blade sides have an angle of 25 degrees. The log is usually driven by a torque of 500 kg per meter on the average.

FIGS. 8–13 show further embodiments which are derived from the configuration of edge members 4 discussed hereinabove in conjunction with FIG. 6.

Arrangements depicted in FIGS. 8 and 9 and 10 and 11 commonly include edge members 4 mounted on a drive roller 3 in such a manner as to cut both into part of a log immediately ahead of the cutting position and into part of a veneer sheet immediately past the cutting position. Guide members 20 are received in annular recesses 31 in opposing relation to a veneer sheet just turned from a log so as to promote smooth separation of the veneer sheet 7 from the edge members 4. Such a structure particularly enhances the tendering effect for the veneer sheet thereby offering veneer sheets which are easy to handle. Moreover, the drive roller 3 can be positioned close to the cutting edge of the knife 2. Although not shown, the drive roller 3 may be positioned somewhat upwardly of the cutting edge of the knife 2 and have its edge members 4 driven into only part of the outer periphery of a log which is about to be cut by a knife. This alternative design also suffices to drive a log though the tendering effect may be degraded. In any of the above cases, the knife 2 and drive roller 3 are connected integrally with a carrier as seen in FIG. 1 and fed inwardly toward the center of rotation of the log as the cutting operation proceeds.

Figure 8:
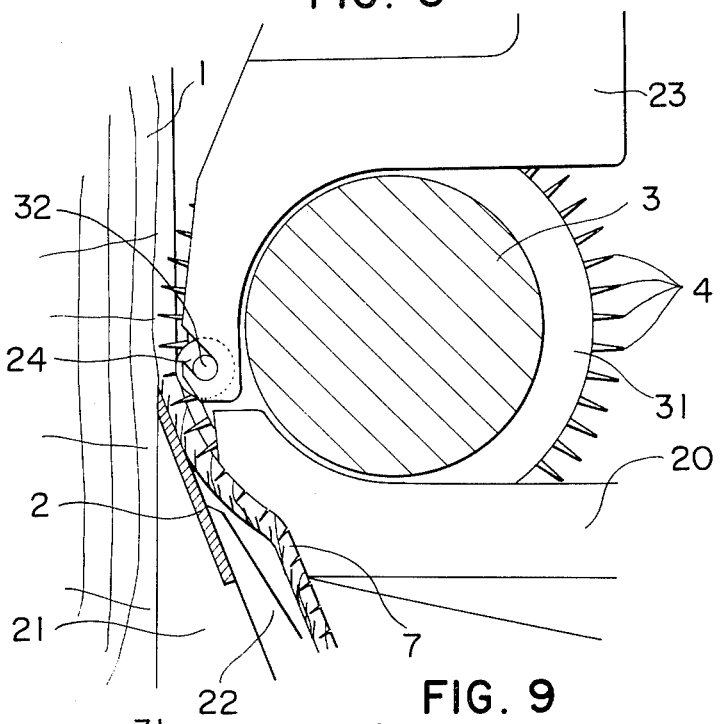
FIG. 8 is a fragmentary side elevation of another embodiment of the present invention.
Figure 9:
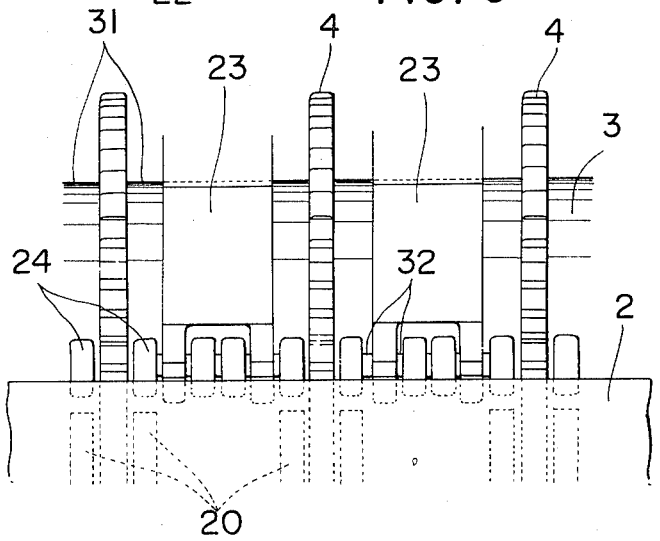
FIG. 9 is a front view relevant to FIG. 8.
Figure 10:
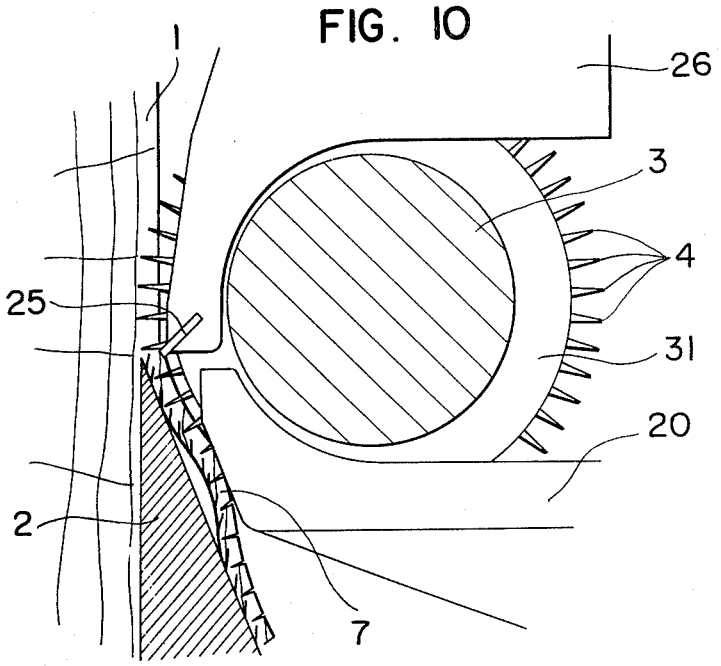
FIG. 10 is a fragmentary side elevation of a still further embodiment of the present invention.
Figure 12:
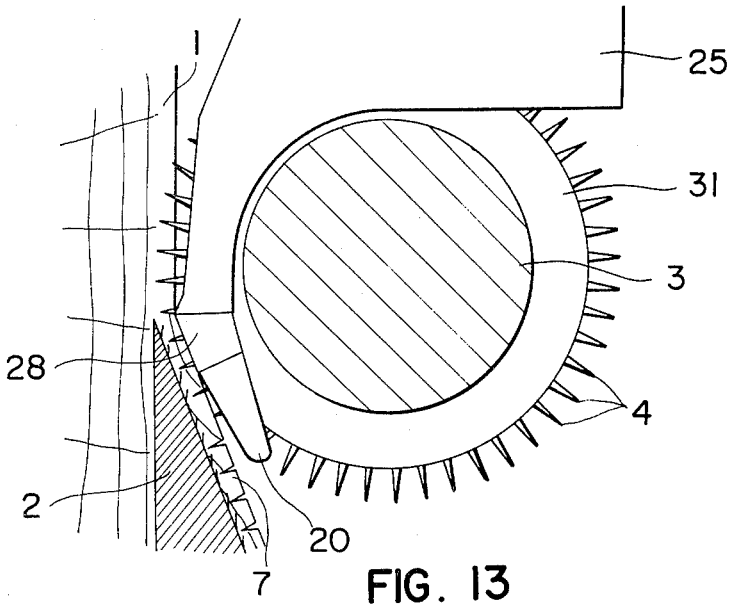
FIG. 12 is a fragmentary side elevation of a still further embodiment of the present invention.

The guide members 20 as shown in FIG. 10 for example extend from the corresponding annular recesses 31 of the drive roller 3 to face the path for the passage of a veneer sheet just cut from the log, and each of the members 20 has a guide surface for guiding the veneer sheet outwardly away from the drive roller 3. Thus, the guide members 20 serve to separate a veneer sheet smoothly from the edge members 4 immediately after the sheet is cut off from a log. Moreover, no slivers and chips remain on and around the edge members 4 thus, facilitating the clean penetration of the edge members 4. The guide members 20 are particularly effective when installed in a veneer lathe of the type shown in FIG. 10 wherein, since the edge embers 4 of the drive roller 3 engage both the log and the resultant veneer sheet at opposite sides of the cutting position, the separation of the veneer sheet is not smooth and chips are liable to accumulate on the edge members. The guide member 20 shown in FIGS. 8 and 9 on the other hand has a curved slant not only guiding a veneer sheet 7 just cut from a log but curving it such that the outer surface of the veneer sheet is stretched, thus assisting particularly in the tendering of a veneer sheet of a material which the drive roller 3 can tender only sparingly. For this reason, the configuration of the guide members 20 shown in FIGS. 8 and 9 is suited for the production of veneer sheets which are as flat as possible. FIG. 12 shows a guide member 20 which is formed integrally with a pressure bar 25. Other possible configurations of guide members include the one in which they are integral with a roller bar support 26 mounted around a drive roller 3 for supporting a roller bar 24 as seen in FIG. 8, and one in which they are integral with a pressure bar support 26 depicted in FIG. 10.

Turning back to FIGS. 8 and 9, a drive roller 3 having a number of edge members 4 and a plurality of annular recesses 31 on its outer periphery is disposed in a position slightly ahead of the cutting edge of a knife 2. Defined between the knife 2 and the drive roller 3 is a path for the passage of a sheet of veneer just cut from a rotating log. Also employed in the veneer lathe of this embodiment are a mechanism 12 which, as shown in FIGS. 2-*a* to 2-*d* by way of example, drives the drive roller 3 for applying a power to part of the outer periphery of a log that is about to be cut by the cutting edge of the knife. The roller bars 24 are received in the recesses 31 of the drive roller 3. Since their primary importance is placed on the drive of a log, the edge members 4 carried on the drive roller 3 are axially spaced from neighboring ones within a range permissible for an intended driving ability. A veneer sheet produced with this arrangement will obtain a further improved condition on its cut surface as compared with a veneer sheet obtainable with the cutting mechanism made up only of the edge 2 and the drive roller 3. Moreover, the veneer lathe can cut favorable veneer sheets from a variety of qualities of wood. The roller bars 24 shown in the drawings are readily mountable to and demountable from corresponding roller bar supports 23. A rod 32 having miniature bearings therewith is snugly received in cutouts provided to an extreme end portion of the corresponding roller bar support 23. Roller bars of such a construction have their resistance reduced to a marked extent. The roller bars 24 illustrated as being axially discontinuous achieves the same effect as that obtainable with a conventional roller which is continuous to a given distance. Yet the roller bars 24 press a log with a reduced force small enough to avoid breakage of the log while serving to provide a veneer sheet with a uniform thickness. The use of roller bars tends to reduce the cutting resistance as compared with the use of fixed bars. However, since the knife 2 penetrates into a log only after the log is somewhat tenderized by the edge members 4 of the drive roller 3, the compression rate by the roller bars 24 can be somewhat decreased with the result that the cutting resistance can be further decreased.

The knife 2 shown in FIG. 8 is of a small-sized replacable type which is retained by a support edge 21 and a retainer 22. The replacement of the knife 2 can be performed easily according to requirement so that the operating cost can be cut down.

Figure 11:
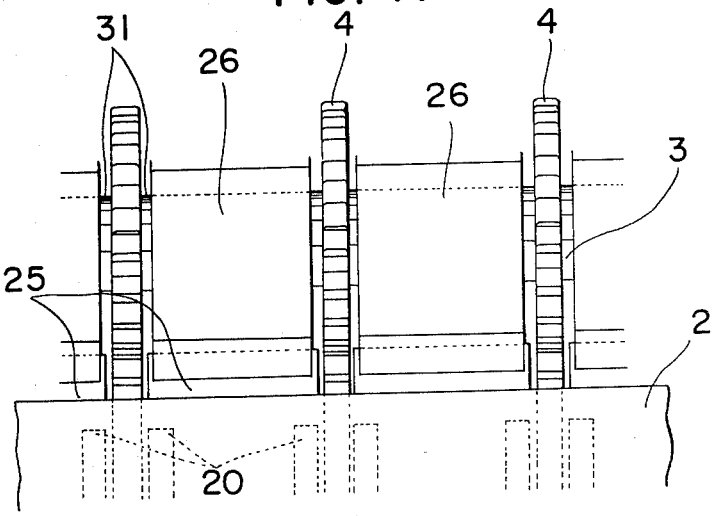
FIG. 11 is a front view relevant to FIG. 10.

A veneer lathe illustrated in FIGS. 10 and 11 includes non-rotatable or stationary pressure bars 25 in place of the roller bars 24 employed in the veneer lathe of FIGS. 8 and 9. Each of the pressure bars 25 is in the form of a strip snugly yet replacably received in an elongate recess formed in an extreme end portion of a pressure bar support 26. When damaged by a foreign object possibly present in a log, the pressure bar 25 can readily be replaced with a new one enhancing the operation rate of the veneer lathe and the decrease of the operating cost.

Figure 13:
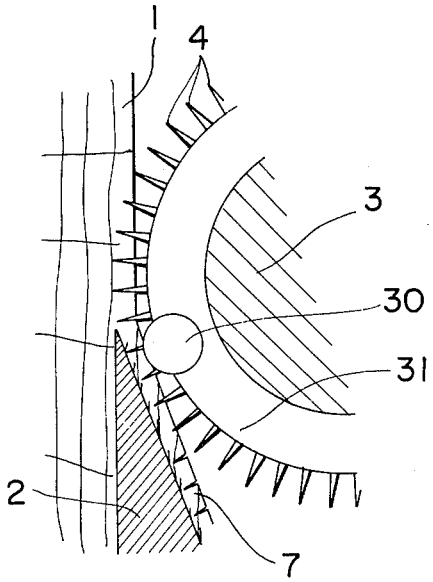
FIG. 13 is a fragmentary side elevation of a still further embodiment of the present invention.

Turning to FIGS. 12 and 13 showing further embodiments of a veneer lathe of the invention, the veneer lathes are common to each other in that a drive roller 3 having a number of edge members 4 and a plurality of annular recesses on its periphery is located slightly ahead of the cutting edge of a knife 2 while defining a path between it and the knife 2 for the passage of a veneer sheet just cut off from a log, and in that mechanism 12 for driving the drive roller 3 is provided as in FIGS. 2*a* to 2*d* to apply a power to part of a log which is about to be cut by the knife. A characteristic feature of these two embodiments resides in the provision of pressing members which are received in the recesses 31 to compress a cut-off veneer sheet 7 at a position past the cutting edge of the knife 2 in a direction opposite to the intended direction of veneer discharge. The pressing members in FIG. 12 comprise stationary members 28 integral with a stationary pressure bar 25 and guide members 20. Due to the frictional resistance between the pressing members 28 and the veneer sheet 7 and that between the veneer sheet and the knife 2, part of the veneer sheet 7 just cut off from the log is compressed in the opposite direction to the direction of discharge so that the veneer sheet obtains sufficient flatness and strength without any splits on its back which would otherwise curl the sheet. Rollers 30 serving as the pressing members in FIG. 13 are driven at a peripheral speed slightly lower than the discharge speed of the veneer sheet and, hence, part of the veneer sheet 7 just cut off from the log is compressed in the opposite direction to the direction of discharge because of an increase in the frictional resistances between the veneer sheet 7 and the rollers 30 and between the veneer sheet 7 and the knife 2. Thus, the resultant veneer sheet is flat and strong since it bears hardly any splits on its back.

The stationary portion 28 shown in FIG. 12 is generally called a "double-face bar" or "restraining bar" if formed integrally with the pressure bar 25 and it is known that the restraint at a point past the cutting edge of the knife 2 is effective for the prevention of splits on the back of a veneer sheet. Meanwhile Japanese Patent Application No. 49-106904 (1974) teaches that resistance members such as rollers 30 shown in FIG. 13 effectively prevent a veneer sheet from being split on its back and/or curled when compressing that part of the veneer sheet just cut off from a log in the opposite direction of discharge. So far, however, these have not been able to be readily put to practical use notwithstanding the theoretically expected effectiveness. The difficulty resides in that such attempts add to the cutting resistance of a conventional veneer lathe which has been liable to break a log as mentioned hereinabove, and in that wedging of slivers and chips is more probable. Compression of a veneer sheet just cut from a log is made possible by the present invention as described in FIG. 12, thus avoiding defects of the prior art.

It will be appreciated from the foregoing that a veneer lathe according to the present invention achieves objectives including the cutting of wood which has hitherto been considered unsuitable for the production of veneer sheets while affording a variety of other advantages and, hence, provides an improvement over conventional veneer lathes.

What is claimed is:

1. A veneer lathe comprising:

means for supporting a log rotatably about its axis;

a drive roller disposed in a facing relation to the log;

a knife oriented in tangential relation to the log;

a plurality of edge members mounted on the drive roller in at least one row around its periphery, said edge members being engageable with the log to rotate it when the drive roller is rotated;

pressure means disposed around said drive roller on at least one side of said row of said edge members to face the log surface slightly ahead of the edge of said knife; and means for feeding the drive roller, the knife, and the pressure means toward the log, and means for rotating the drive roller, such that said edge members on the drive roller come into piercing engagement with the log surface to rotate the log slightly ahead of the knife edge, said feeding means being adapted to continue the feed in accordance with the decrease in the log diameter.

2. A veneer lathe as claimed in claim 1, wherein said log supporting means includes means which is operatively connected with a drive source and drives the log for rotation with a torque smaller than that necessary for cutting the log.

3. A veneer lathe as claimed in claim 2, wherein said log driving means includes a friction clutch.

4. A veneer lathe as claimed in claim 3, wherein said friction clutch includes means for adjusting its frictional force.

5. A veneer lathe as claimed in any of claims 2, 3 or 4, wherein the log under non-cutting conditions is driven by said log driving means at a peripheral speed which is higher than the peripheral speed of said drive roller under loaded cutting conditions, said drive roller being driven by drive means having an overrunning clutch.

6. A veneer lathe as claimed in claim 5, wherein said veneer lathe further comprises an auxiliary drive roller contacting the outer periphery of the log and applying rotational power thereto.

7. A veneer lathe as claimed in claim 6, wherein said auxiliary drive roller is positioned substantially on the opposite side of said drive roller with respect to the log.

8. A veneer lathe as claimed in claim 1 wherein additional edge members are carried on the outer periphery of said drive roller and are spaced from said one row of edge members axially of said drive roller.

9. A veneer lathe as claimed in claim 8, wherein said edge members are arranged also circumferentially of said drive roller to form a plurality of disc-shaped portions on said drive roller and a plurality of annular recesses alternating with said disc-shaped portions on said drive roller.

10. A veneer lathe as claimed in claim 9, wherein said edge members extend radially outwardly from the outer periphery of said drive roller.

11. A veneer lathe as claimed in claim 9, wherein said edge members are inclined at common angles forwardly with respect to direction of rotation of said drive roller from the radial direction of said drive roller.

12. A veneer lathe as claimed in any of claims 9, 10 or 11, wherein said drive roller is located in a position in which said edge members on said drive roller cut into both part of the log which is about to be cut by said knife and part of a veneer sheet just cut off from the log.

13. A veneer lathe as claimed in claim 1, wherein said pressure means is smaller in height than said edge members.

14. A veneer lathe as claimed in any of claims 9, 10, 11, 12 or 13, wherein means 11 received in said recesses to compress in a discharging direction part of a veneer sheet just cut off from the log.

15. A veneer lathe as claimed in any of claims 8, 9, 10, or 11, wherein said veneer lathe further comprises an auxiliary drive roller for contacting the outer periphery of the log and applying rotational power thereto.

16. A veneer lathe as claimed in claim 15, wherein said auxiliary drive roller is positioned substantially on the opposite side of said drive roller with respect to the log.

17. A veneer lathe according to claim 1, wherein said drive roller is disposed to bring its edge members into piercing engagement with both the log surface and the veneer sheet being cut therefrom.

18. A veneer lathe according to claim 1, further comprising a guide member disposed around the drive roller on at least one side of the edge member row for disengaging the cut-off veneer sheet from the piercing edge members, said pressure means and said guide member means being out of interference with each other.

19. A veneer lathe according to claim 1, further including resisting means disposed between said guide member and said pressure means for resisting the log rotation to compress the cut-off veneer sheet lengthwise.

20. A veneer lathe according to claim 1, wherein said drive roller is provided with an over-running clutch.

21. A veneer lathe comprising:

means for supporting a log rotatably about its axis;

at least one drive roller disposed in a facing relation to the log and having a plurality of edge members mounted on the drive roller in at least one row around its periphery, said edge members being engageable with the log to rotate it when the drive roller is rotated;

a knife oriented in tangential relation to the log;

pressure means disposed on one side of said drive roller to face the log for pressing the same slightly ahead of the knife edge;

means for feeding the drive roller, the knife, and the pressure means toward the log, and means for rotating the drive roller, such that said edge members on the drive roller come into piercing engagement with the log surface to rotate the log slightly ahead of the knife edge, said feeding means being adapted to continue the feed in accordance with the decrease in the log diameter.

* * * * *